US008659514B2

(12) United States Patent
Sato et al.

(10) Patent No.: US 8,659,514 B2
(45) Date of Patent: Feb. 25, 2014

(54) LED MATRIX DRIVER GHOST IMAGE PREVENTION APPARATUS AND METHOD

(75) Inventors: Etsuji Sato, Singapore (SG); Atsushi Kitagawa, Kanagawa (JP); Yoshihito Kawakami, Kanagawa (JP); Chun Kiong Leslie Khoo, Singapore (SG); Ulysses Ramos Lopez, Singapore (SG); Narciso Repollo Semira, Singapore (SG); Jiong Fu, Singapore (SG)

(73) Assignees: Panasonic Corporation, Osaka (JP); Panasonic Semiconductor Asia Pte. Ltd., Singapore (SG)

( * ) Notice: Subject to any disclaimer, the term of this patent is extended or adjusted under 35 U.S.C. 154(b) by 480 days.

(21) Appl. No.: 13/004,277

(22) Filed: Jan. 11, 2011

(65) Prior Publication Data

US 2012/0176062 A1 Jul. 12, 2012

(51) Int. Cl.
*H05B 37/00* (2006.01)

(52) U.S. Cl.
USPC ..... 345/76; 345/82

(58) Field of Classification Search
USPC ..... 345/76, 77, 82; 315/169.3, 169.1, 291, 315/307, 308
See application file for complete search history.

(56) References Cited

U.S. PATENT DOCUMENTS 7,728,806 B2 * 6/2010 Shin ..... 345/98
2010/0253706 A1 * 10/2010 Shirouzu ..... 345/690
2011/0058050 A1 3/2011 Lasang et al.

OTHER PUBLICATIONS

"Eliminating Ghost-currents in Color-LED Display System using the MAX6972-MAX6975 LED Drivers", pp. 1-10, Aug. 29, 2007.

* cited by examiner

*Primary Examiner* — David H Vu
(74) *Attorney, Agent, or Firm* — Greenblum & Bernstein, P.L.C.

(57) ABSTRACT

LED drivers specially directed to LED matrix driver's ghost image prevention is disclosed. The LED driver receives an external input and decodes the input to produce a time multiplex timing on turning on an LED array. The LED driver inserts a dead time to the outputs and during this time the ghost image prevention circuit discharges the output stray capacitances to a predetermined level.

14 Claims, 9 Drawing Sheets

LED MATRIX DRIVER GHOST IMAGE PREVENTION APPARATUS AND METHOD

BACKGROUND OF THE INVENTION

The present invention relates to LED drivers and, more particularly, to LED matrix driver ghost image prevention apparatus and method.

Light Emitting Diodes or LEDs are often used in visual applications that require time-multiplexing of numerous LEDs in the display. Time-multiplexing is a scheme that involves connecting the cathodes of multiple LEDs to each OUT pin of the LED driver. A time-multiplexed circuit is advantageous because it uses fewer LED drivers for a given amount of LEDs, which results in lower cost and smaller size. One major drawback to time-multiplexing is a side-effect called ghosting. The ghosting phenomenon is caused by stray board capacitance which can force time-multiplexed LEDs to flash when they should be off.

For the purpose of understanding how ghost-image is produced, an exemplary conventional time multiplex LED driver is presented as have been describe in MAXIM application note 411, titled "Eliminating Ghost-currents in Color-LED Display System using the MAX6972-MAX6975 LED Drivers". Referring to FIG. 1, the multiplexing transistors (Q1 and Q2) are alternately turned on by the LED Driver IC while the constant current-sinking drive pins (OUT1-OUT3) alternate control settings between the two phases. During Phase 1 (FIG. 2), MUX1 pin is low, Q1 is turned on, and node A is pulled to the LED supply, VLED, thereby connecting LED2, LED4, and LED6 anodes to the LED supply. Likewise, during Phase 2, MUX2 is low and Q2 is turned on, connecting LED1, LED3, and LED5 anodes to the LED supply. The MUX1 and MUX2 outputs turn on the PNP transistors by sinking base current through the resistors via their open-drain drivers. When MUX1 and MUX2 are off, the open-drain outputs are essentially open-circuit, allowing the base-emitter resistors to turn off the PNP transistors. Between each MUX1 and MUX2 phase, both Q1 and Q2 are off, which is shown as $t_{EMUX}$ in FIG. 2. Faint ghost images from parasitic currents occur during the transition from MUX1 to MUX2 and vice versa. The effects are most pronounced when the LEDs on the multiplexed circuits are different colors (light wavelengths) and, hence, have significantly different voltage drops for a given current flow. Further referring to FIG. 1, assuming all odd numbered LED are green and even numbered LED are red, and assuming that The voltage drops of LEDs are:

$V_{RED}$=2V $V_{GREEN}$=3.1V

The supply voltage:

+VLED=5V

At phase 1, with Q1 turned on, the anode of the red LEDs will be connected to the supply voltage, this will in turned charge the parasitic capacitor Cp1 at node A to approximately 5V. With Outputs OUT1-OUT3 active and assuming the voltage drop of the PNP transistor to be negligible, all LED cathodes will be pulled to a voltage approximately equal to:

$$5V-V_{RED}=3V \quad \text{(eq. 1)}$$

When phase 1 ends, the 3 output drivers will be off and MUX1 will be inactive, disconnecting the anode of the LEDs from the supply voltage. Since there are no discharge paths for the parasitic capacitor the voltage at node A will remain close to the supply voltage. When phase 2 begins, MUX 2 will be low, Q2 turn on, the anode of green LED is connected to 5V, and Outputs OUT1-OUT3 are activated. The voltage at the cathodes of the all LEDs will then be approximately equal to:

$$5V-V_{GREEN}=1.9V \quad \text{(eq. 2)}$$

With all cathode voltage approximately equal to 1.8V, the anode of the red LED will need to discharge to $$1.8V+V_{RED}=3.8V \quad \text{(eq. 3)}$$

From 5V voltage at node A at the beginning of phase 2 node A will discharge to 3.8V through the red LED. This discharging produces a faint illumination or ghost image on one or more red LEDs.

The ghost image can be eliminated by providing a discharge path for the parasitic capacitor Cp1-Cp2 and providing time for the discharge to occur. This is accomplished by adding R1 and R2, as shown in FIG. 3. However this method does not give solution to the stray capacitances Cp3-Cp5 present on the OUT pins and the method presented also lowers the efficiency due to the current which are consumed by the additional resistor. Furthermore this technique is limited to only LED time multiplex circuit arrangement as discussed above. For LED time multiplexed circuit where every LED output drives both anodes and cathodes of LEDs, as shown in FIG. 4, this method may not suitable. In this LED driver architecture the driver outputs Z1-Z3 function as a switch to connect the LEDs to the power supply or constant current supply. The main objective of the current invention is to provide the most effective prevention to LED ghost image without sacrificing efficiency.

SUMMARY OF THE INVENTION

The purpose of this invention is to provide a method and apparatus that prevents the occurrence of ghost images in LEDs, without the efficiency loss.

According to the present invention, a method of removing ghost-image currents occurring in an arrangement of a plurality of LEDs, comprises:

generating a dead time between the turning on of subsequent multiplexing transistors; and discharging of parasitic capacitances to a pre-determined voltage level.

According to the present invention, the pre-determined voltage level is equal to half of the power supply voltage.

According to the present invention, the discharging step is performed at all anode and cathode nodes of the LEDs.

According to the present invention, an apparatus for removing the ghost-image currents occurring in an arrangement of a plurality of LEDs, comprises:

a multiplexing controller to generate signals to control the operation of the arrangement of a plurality of LEDs;

a plurality of multiplexing transistors to control the voltages applied to the anode and cathode terminals of the LEDs;

a plurality of discharging devices, each having a first terminal electrically coupled to the multiplexing controller, having a second terminal electrically coupled to a path that leads to the power supply, having a third terminal electrically coupled to a path that leads to ground, and having a fourth terminal electrically coupled to each one of the anode and cathode terminals of the LEDs.

According to the present invention, the discharging device further comprises:

a PMOS transistor, having its gate terminal electrically coupled to the multiplexing controller, having its drain terminal electrically coupled to a first terminal of a first resistor, and having its source terminal electrically coupled to the path that leads to the power supply, a first resistor, having its first terminal electrically coupled to the drain terminal of the first NMOS and having its second terminal coupled to the anode and cathode terminals of the LEDs;

a second resistor, having its first terminal electrically coupled to the anode and cathode terminals of the LEDs and having its second terminal electrically coupled to a drain terminal of an NMOS transistor;

an NMOS transistor, having its source terminal electrically coupled to a path that leads to ground, having its drain terminal electrically coupled to the second terminal of the second resistor and having its gate terminal electrically coupled to the multiplexing controller.

According to the present invention, the discharging device further comprises at least one current driver operative disposed of between the output of the multiplexing controller and the gate terminals of the first and second NMOS transistors.

DETAILED DESCRIPTION OF THE PREFERRED EMBODIMENTS

Figure 1:
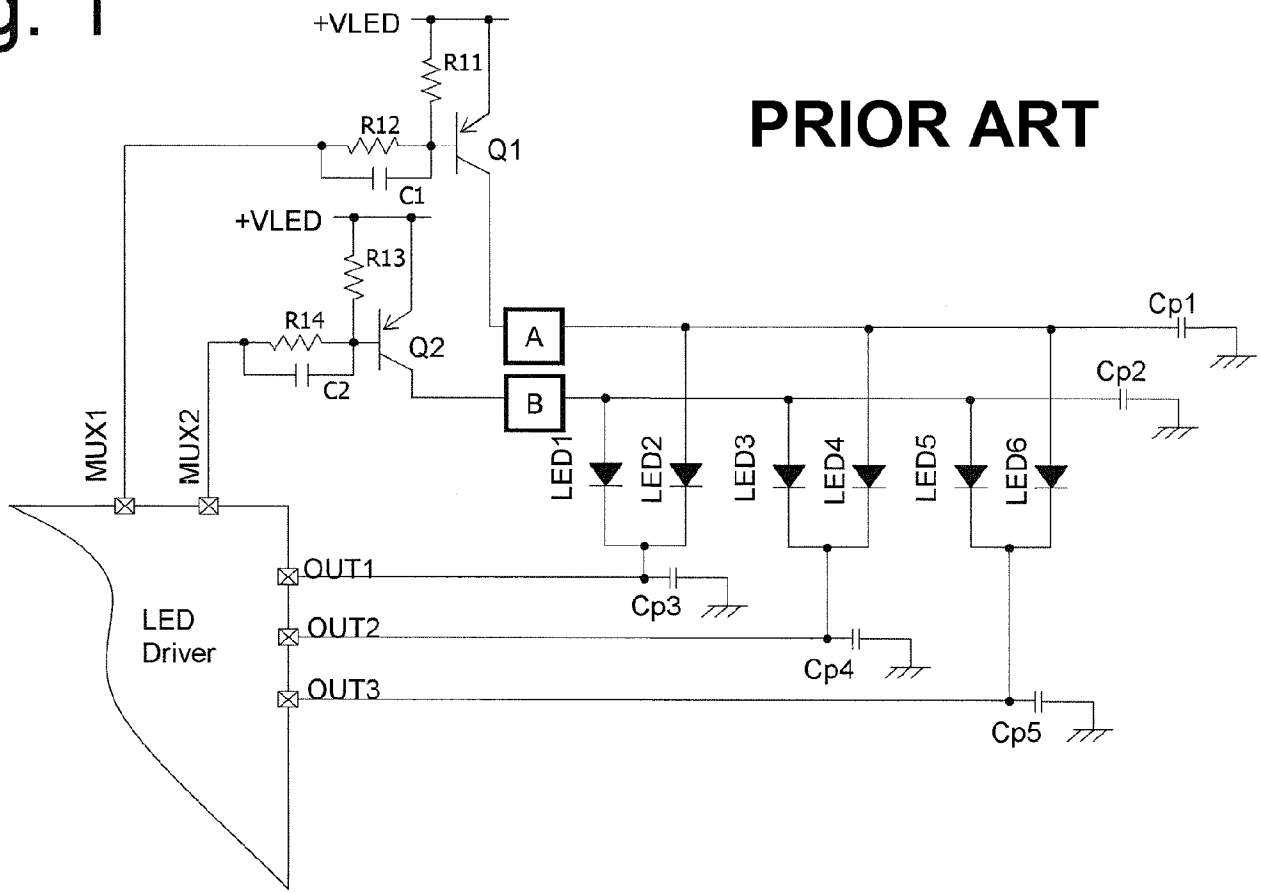
FIG. 1 is showing an application circuit diagram of a Time-multiplex LED Driver system, according to the prior art.
Figure 2:
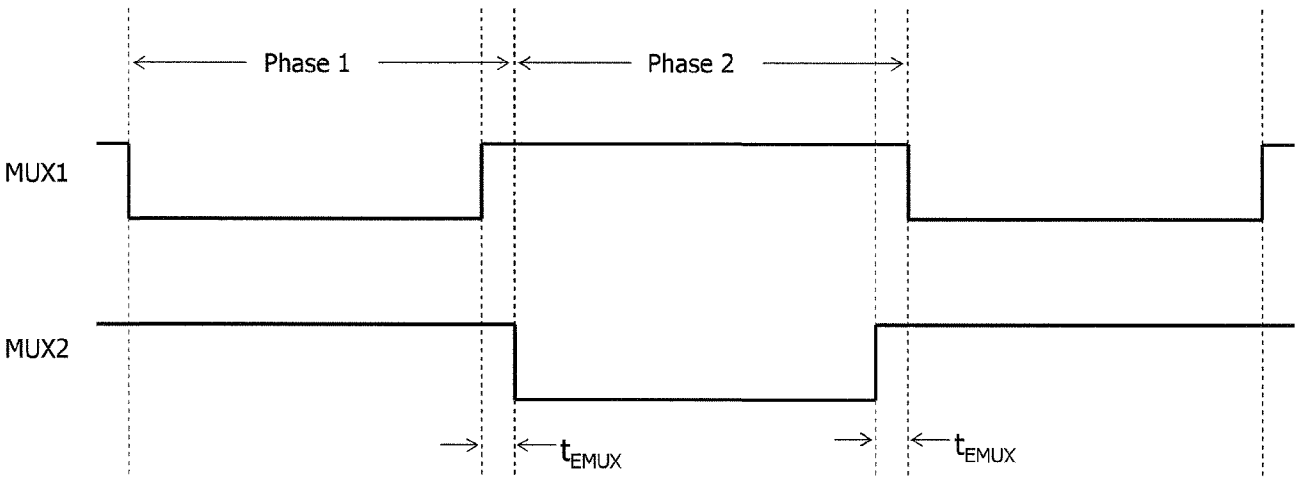
Fig. 2 PRIOR ART
FIG. 2 is a timing diagram illustrating the timing of the output that controls the PNP bipolar transistor, according to the prior art.
Figure 3:
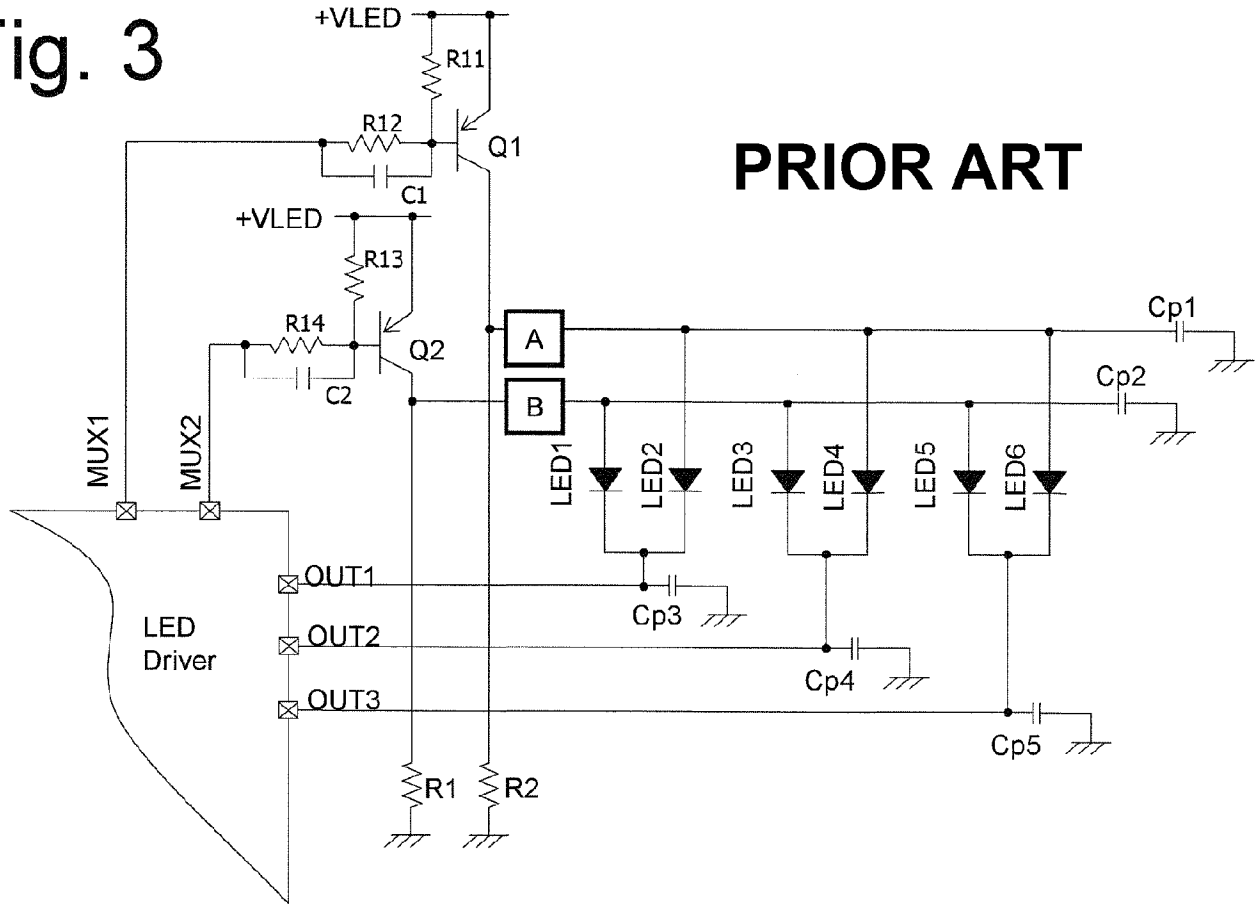
FIG. 3 is showing an application circuit diagram of a Time-multiplex LED Driver system implementing Ghost image prevention, according to the prior art.
Figure 4:
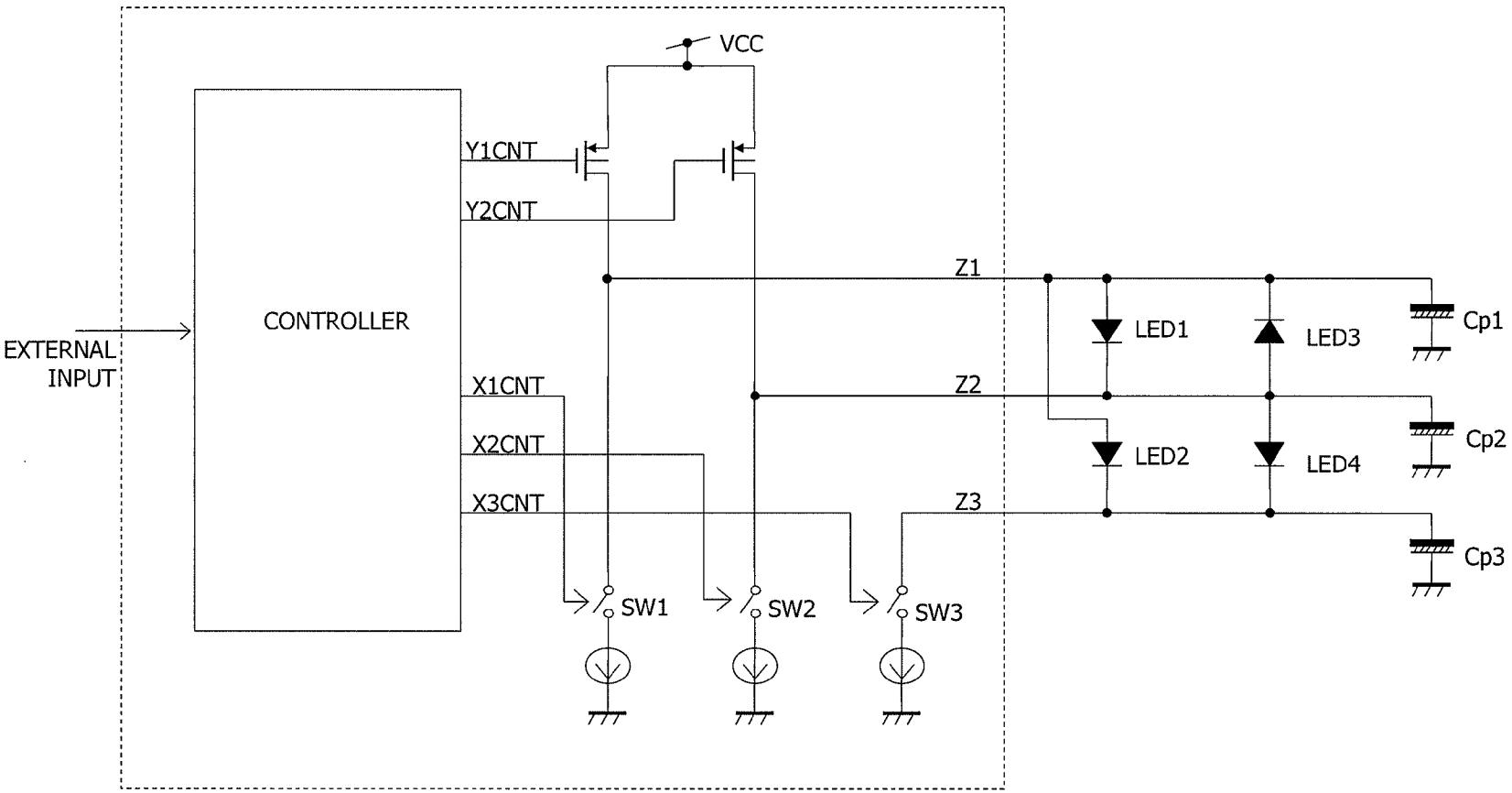
FIG. 4 is showing a simplified circuit diagram of a Time-multiplex LED Driver system, according to the present invention.

To solve the problem stated above, the present invention has been made and it is an object of the invention to provide solution in preventing the occurrence of ghost images in LED matrix drivers.

It is to be understood that the figures and description of the present invention may have been simplified to illustrate relevant elements for a clear understanding of the present invention. Those of ordinary skill in the art will recognize that other element may be required in order to implement the present invention. However, because such elements are well known in the art, discussions of such element were not provided. It is also to be understood that the drawing included herewith only provided diagrammatic representations of the preferred structure of the present invention.

Figure 5:
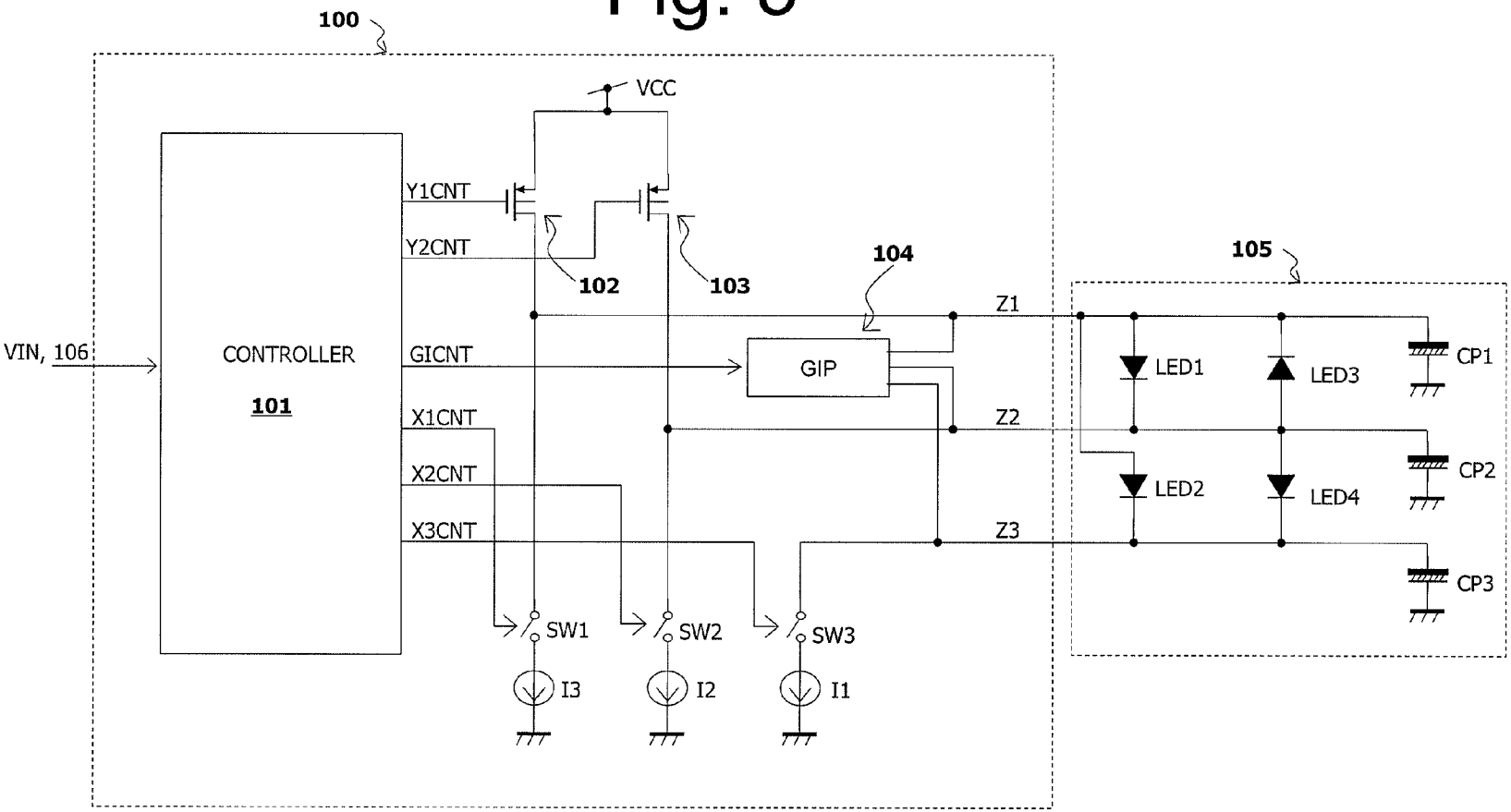
FIG. 5 is showing a simplified circuit diagram of a Time-multiplex LED Driver system implementing Ghost image prevention, according to the present invention.
Figure 9:
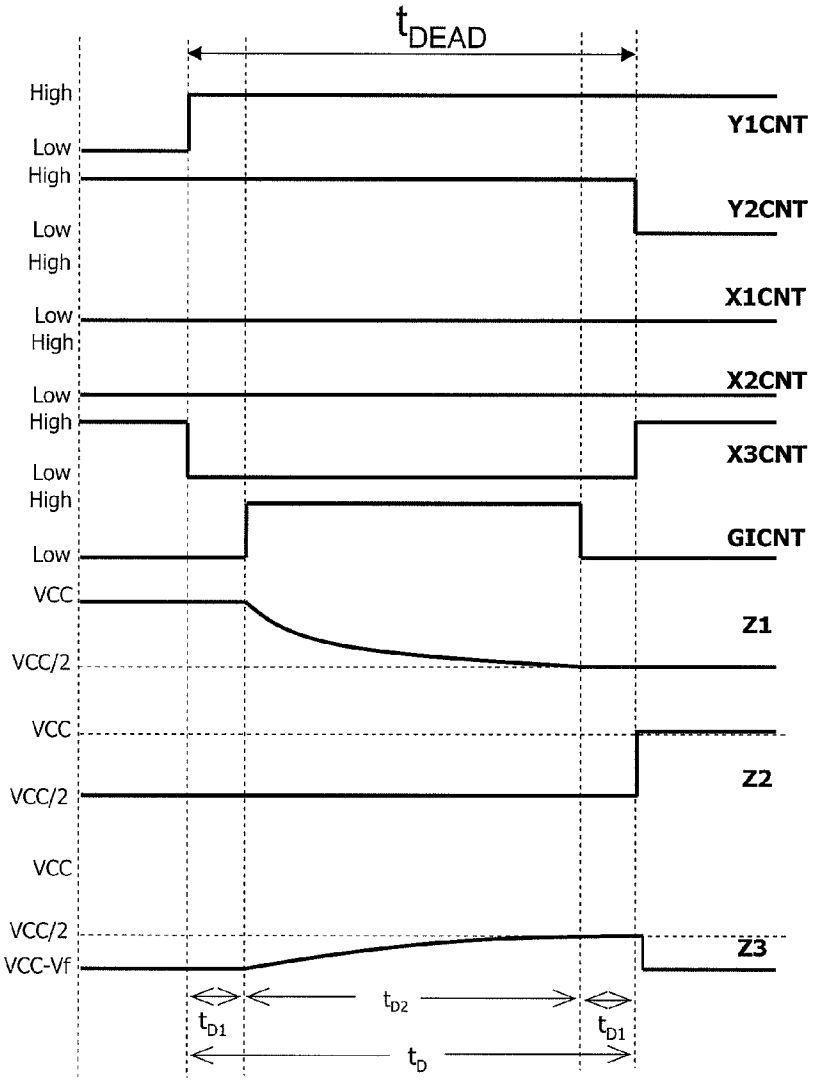
FIG. 9 is a timing diagram showing the expanded view of the dead-time.

Referring to FIG. 5, the first embodiment of an LED matrix driver 100, capable of removing ghost-image currents, according to the present invention is presented. For the purpose of simplification, a 2 by 2 matrix system 105 is presented. The LED system can be an n by m LED matrix system where n is the number of LED columns and m is the number of rows. Referring to FIG. 5, external signals VIN 106 is inputted to the controller 101, which will then be decoded. The decoded signal will provide the output to terminals Y1CNT and Y2CNT. The terminal Y1CNT is electrically coupled to the gate of the PMOS transistor 102, while the source terminal of PMOS transistor 102 is electrically coupled directly to the supply voltage VCC and the drain terminal electrically coupled to output Z1. Controller 101 output terminal Y2CNT is electrically coupled to the gate of PMOS transistor 103 and its drain and source terminal electrically coupled to the output Z2 and supply voltage VCC respectively. The output terminals Y1CNT and Y2CNT will alternately turn on the two PMOS transistor according to the decoded external input signal. During each transition between output terminals Y1CNT and Y2CNT, a dead time $t_{DEAD}$ is inserted in order to prevent shoot through current. This is as illustrated in FIG. 9. During the dead time $t_{DEAD}$, the controller 101 will send a high level pulse via output terminal GICNT. Output terminal GICNT is electrically coupled to the input of the ghost image prevention block, GIP 104. This GICNT signal will serve as an enable signal to the ghost image prevention block, GIP 104. The ghost image prevention block, GIP 104's outputs connect to the LED system via outputs Z1, Z2 and Z3, and this connection provide the path in order to discharge the stray capacitances CP1-CP3 at the outputs Z1, Z2 and Z3.

The controller 101 also provides the output terminals X1CNT, X2CNT and X3CNT. These outputs control SW1, SW2 and SW3 switches, respectively. The switch electrically connects the current sources I1, I2 and I3 to output Z1, Z2 and Z3 respectively. These signals produced by output terminals X1CNT, X2CNT and X3CNT may be PWM signals that will increase or decrease the average magnitude of the current sources I1 to I3 which controls the LED's brightness level.

Further referring to FIG. 5 the outputs Z1, Z2 and Z3 connect to each other through the different LEDs, that is, Z1 connects to anode of LED1 and LED2 then the cathode of LED1 and LED2 connects to Z2 and Z3 respectively. LED3 and LED4 anodes connect to Z2 and its cathode to Z1 and Z3 respectively. The capacitors CP1, CP2 and CP3 represent the parasitic capacitance at every one of the output pins Z1-Z3.

Figure 6:
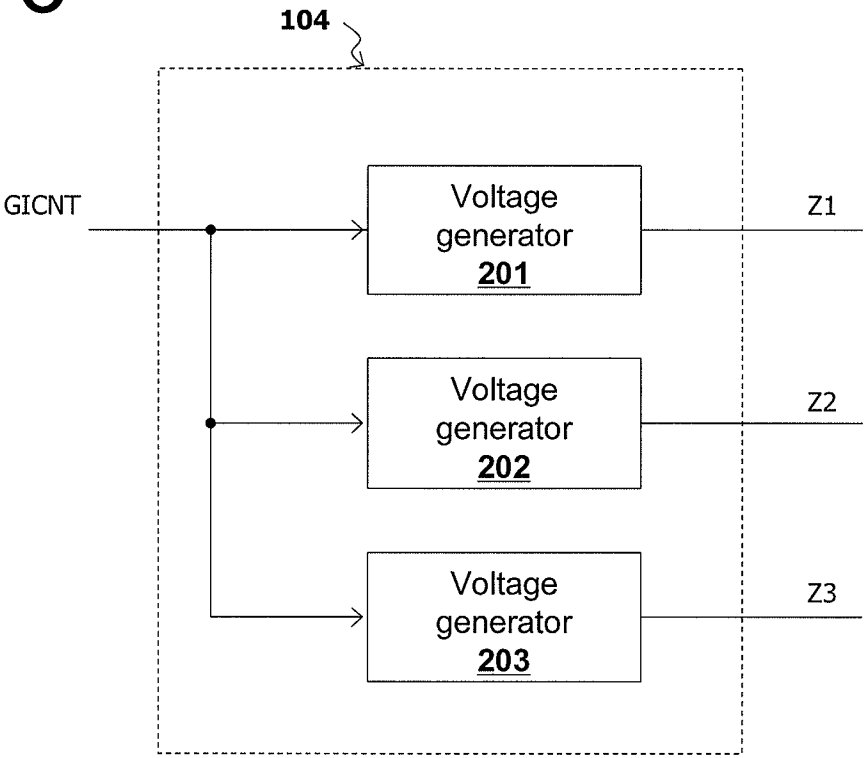
FIG. 6 is showing a basic block diagram of Ghost image prevention, according to the present invention.

An exemplary implementation of the ghost image prevention block, GIP 104 is as shown in FIG. 6. FIG. 6 shows the basic block diagram of the ghost image prevention block GIP 104. The ghost image prevention block GIP 104 consists of identical voltage generators 201, 202 and 203 that receive an enable signal from the controller via output terminal GICNT. When an enable signal is transmitted to the voltage generators 201, 202 and 203, that enable signal will provide a constant voltage at a predetermined level. This action will then force the voltage at outputs Z1, Z2 and Z3 to the predetermined level which will cause the discharging/charging of the parasitic capacitances.

Figure 7:
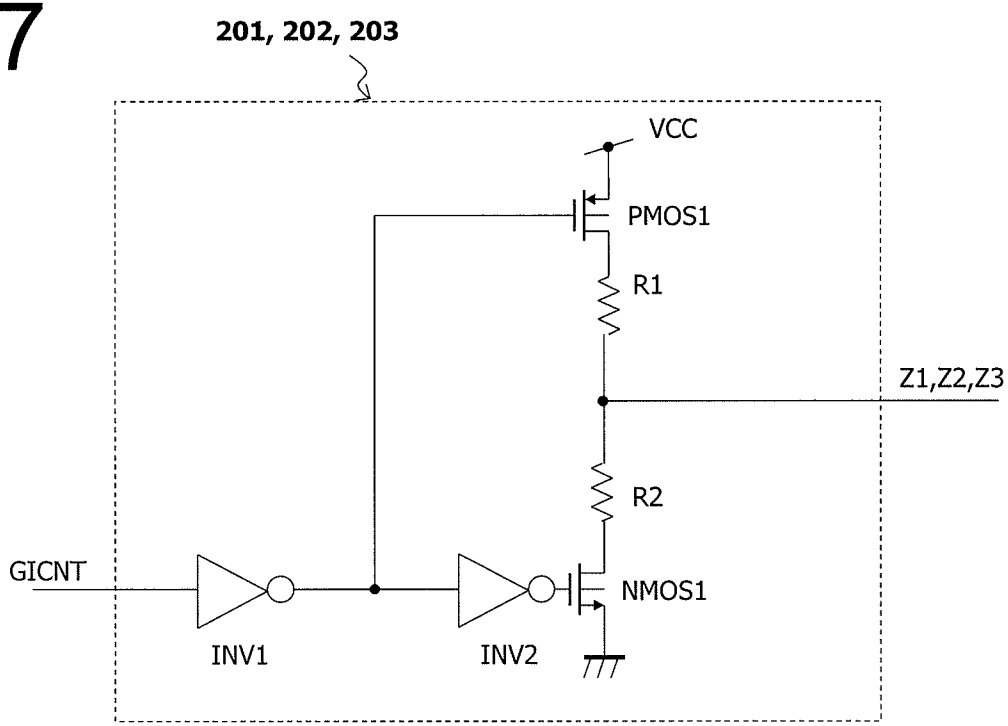
FIG. 7 is showing one possible circuit of implementing the Ghost image prevention, according to the present invention.

FIG. 7 shows one of a possible way of implementation of the voltage generator according to the present invention. The voltage generator can be of any apparatus that will force the LED output at a predetermined voltage level. Referring to the figure, output terminal GICNT connects to the input of an inverter INV1 and its output connected to the input of inverter INV2 and the gate of PMOS1. PMOS1 serves as a transistor switch with its source connected to the power supply and its drain connecting to R1 resistor. While, inverter INV2 output terminal connects to the gate of NMOS1. NMOS1 functions as a switch wherein its drain is connected to resistor R2 and its source terminal connects to ground. The other terminals of R1 and R2 finally connects to the outputs Z1, Z2 and Z3. Assuming R1 and R2 are of the same resistance value, ½ of the supply voltage will be generated at the outputs when the signal at the output terminal GICNT is at high level or VCC level.

Figure 8:
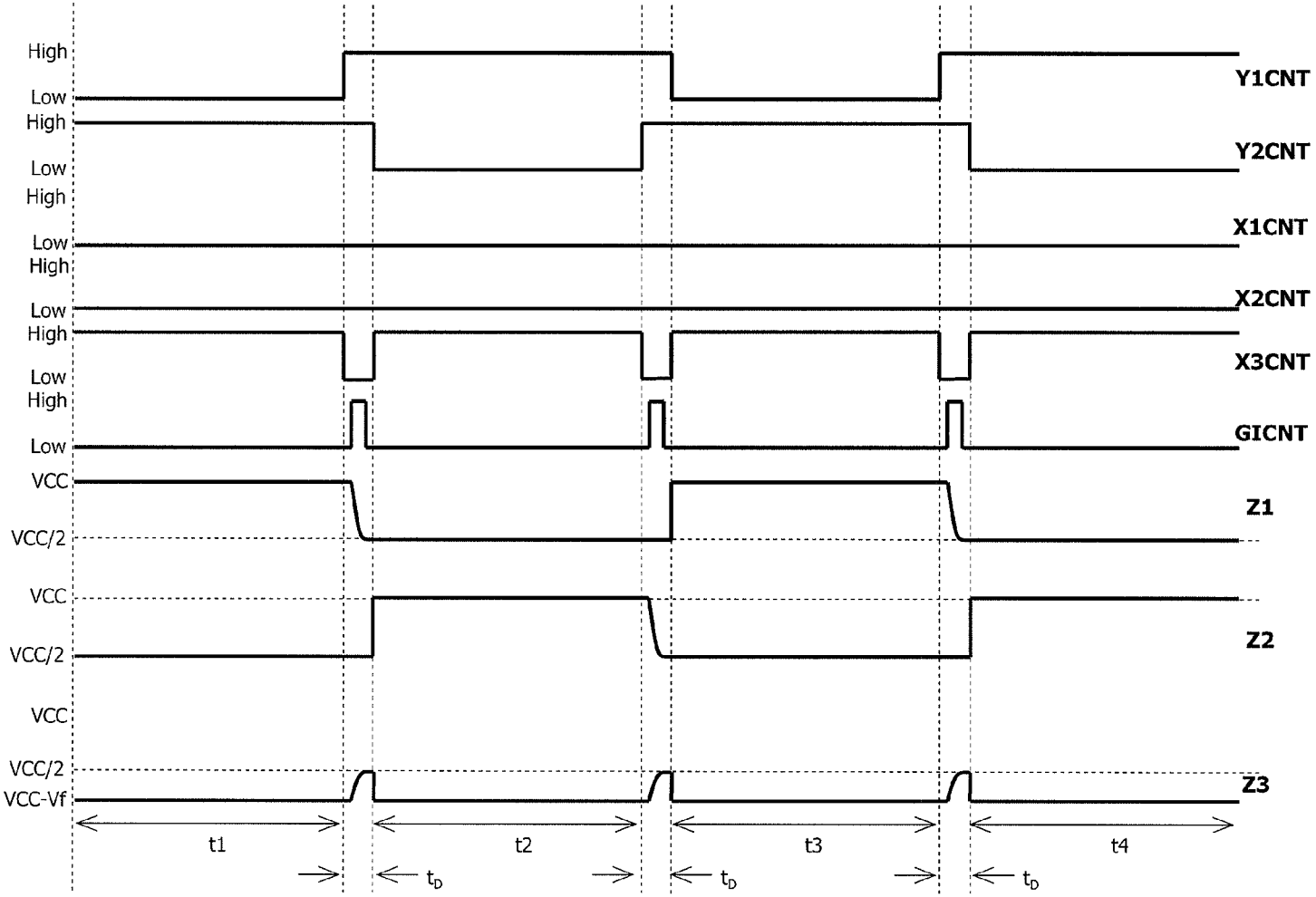
FIG. 8 is a timing diagram showing the timing the operation of a Time-multiplex LED Driver system implementing Ghost image prevention, according to the present invention.

FIG. 8 show a timing diagram according to the present invention. At time t1 the gate of PMOS1 is low resulting Z1 output to be pulled approximately VCC voltage level which will then cause charging of the parasitic capacitor CP1 to VCC level. During this time the signal at output terminal X3CNT is high, thus, connecting 11 to output Z3. With this condition current will flow from the power supply then to LED2 and to GND via SW3 and 11. During t1, the voltage magnitude $V_{Z3}$ generated at Z3 output will be $$V_{Z3}=VCC-Vf \quad \text{(eq. 4)}$$

where VCC is the power supply voltage and Vf is the voltage drop of the LED and is the needed voltage potential for the LED to turn on. When t1 ends, signal at output terminal Y1CNT will be high while the signals at output terminals X1CNT, X2CNT and X3CNT will be low causing Z1-Z3 to go to a HiZ or high-impedance condition. During HiZ condition, the voltage at Z1 will remain at approximately equal to the power supply voltage because the stray capacitance CP1 has no discharge path. The time for this HiZ condition is denoted by $t_{D1}$ as shown in FIG. 9. $t_{D1}$ is inserted to prevent miss operation during the turning off of the PMOS switches and the ghost image prevention block, GIP 104. As can be seen in FIG. 9 $t_{D1}$ is also inserted at the end of GICNT signal. At the end of the first $t_{D1}$, the signal at the output terminal GICNT will change to high level will cause CP1 to discharge to a predetermined level, for this case the LED outputs discharges to voltage half of the power supply. Z2 will also discharge to half VCC level while Z3 will charge up to half VCC level. Please note that Z3 pin may also discharge when VCC−Vf is more than half of VCC. The charging/discharging action will cause all LED output to be at half VCC at the beginning of time t2. When t2 starts PMOS2 will be on and the signal at the output terminal X3CNT will be high causing current to flow through LED4 which was the only LED expected to be on. The ghost images were suppressed due the fact that Z1-Z3 is all at half of the VCC level, and voltage potential are not enough to turn on other LEDs.

Having described the above embodiment of the invention, various alternations, modifications or improvement could be made by those skilled in the art. Such alternations, modifications or improvement are intended to be within the spirit and scope of this invention. The above description is by ways of example only, and is not intended as limiting. The invention is only limited as defined in the following claims.

What is claimed is:

1. An apparatus for controlling voltage applied to terminals of a plurality of light emitting diodes (LEDs), to a predetermined voltage at a predetermined dead time interval, the apparatus comprising:

a multiplexing controller to generate predetermined dead time signals which serve as input signals to a plurality of voltage generators; and said plurality of voltage generators to generate said predetermined voltage which is applied to anode and cathode terminals of said plurality of LEDs.

2. The apparatus according to claim 1, wherein each of said plurality of voltage generators comprises:

a first transistor that connects a power supply to a first resistor;

said first resistor, having a first terminal electrically coupled to said first transistor and having a second terminal electrically coupled to said anode and cathode terminals of one of said plurality of LEDs;

a second resistor, having a first terminal electrically coupled to said anode and cathode terminals of one of said plurality of LEDs and having a second terminal electrically coupled to a second transistor; and said second transistor that connects said second terminal of said second resistor to ground.

3. The apparatus according to claim 2, wherein said first transistor is a PMOS transistor, having a gate terminal electrically coupled to said multiplexing controller, having a drain terminal electrically coupled to said first terminal of said first resistor, and having a source terminal electrically coupled to a path that leads to said power supply.

4. The apparatus according to claim 3, wherein said second transistor is an NMOS transistor, having a source terminal electrically coupled to a path that leads to said ground, having a drain terminal electrically coupled to said second terminal of said second resistor and having a gate terminal electrically coupled to said multiplexing controller.

5. The apparatus according to claim 4, wherein each of said plurality of voltage generators further comprise:

at least one pre-driver operative disposed between an output of said multiplexing controller and said gate terminal of each of said PMOS transistor and said NMOS transistor.

6. The apparatus according to claim 5, wherein said pre-driver operative is an inverter.

7. The apparatus according to claim 5, wherein said inverter is electrically coupled to said multiplexing controller for receiving one of said predetermined dead time signals during said predetermined dead time interval.

8. The apparatus according to claim 6, wherein each of said plurality of voltage generators is identical.

9. The apparatus according to claim 6, wherein said first resistor and said second resistor have a same resistance value.

10. The apparatus according to claim 9, wherein each of said plurality of voltage generators is configured to generate said predetermined voltage during said predetermined dead time interval with said predetermined voltage being equal to half of a power supply voltage of said power supply.

11. The apparatus according to claim 1, wherein said plurality of voltage generators generate said predetermined voltage during said predetermined dead time interval in correspondence with said predetermined dead time signals which are generated by and input from said multiplexing controller during said predetermined dead time interval.

12. The apparatus according to claim 11, wherein each of said plurality of voltage generators is identical.

13. The apparatus according to claim 12, wherein said plurality of voltage generators is configured to apply a power supply voltage to said anode and cathode terminals of at least one of said plurality of LEDs during a first time interval, and configured to apply said predetermined voltage to said anode and cathode terminals of each of said plurality of LEDs during said predetermined dead time interval subsequent to said first time interval, and said predetermined voltage is equal to half of the power supply voltage.

14. The apparatus according to claim 12, wherein said plurality of voltage generators is configured to apply a power supply voltage to said anode and cathode terminals of at least one of said plurality of LEDs during a first time interval, and configured to apply said predetermined voltage to said anode and cathode terminals of each of said plurality of LEDs during said predetermined dead time interval subsequent to said first time interval, and said predetermined voltage is not enough to turn on said plurality of LEDs.

* * * * *